US010081874B2

(12) United States Patent
Zhu et al.

(10) Patent No.: US 10,081,874 B2
(45) Date of Patent: Sep. 25, 2018

(54) METHOD FOR ELECTROWINNING TITANIUM FROM TITANIUM-CONTAINING SOLUBLE ANODE MOLTEN SALT

(71) Applicant: Hongmin Zhu, Beijing (CN)

(72) Inventors: Hongmin Zhu, Beijing (CN); Qiuyu Wang, Beijing (CN); Shuqiang Jiao, Beijing (CN)

(73) Assignee: Hongmin Zhu, Beijing (CN)

( * ) Notice: Subject to any disclaimer, the term of this patent is extended or adjusted under 35 U.S.C. 154(b) by 108 days.

(21) Appl. No.: 15/022,324

(22) PCT Filed: Sep. 15, 2014

(86) PCT No.: PCT/CN2014/086581
§ 371 (c)(1),
(2) Date: Mar. 16, 2016

(87) PCT Pub. No.: WO2015/035954
PCT Pub. Date: Mar. 19, 2015

(65) Prior Publication Data

US 2016/0222533 A1 Aug. 4, 2016

(30) Foreign Application Priority Data

Sep. 16, 2013 (CN) ..... 2013 1 0421132

(51) Int. Cl.
*C25C 3/28* (2006.01)

(52) U.S. Cl.
CPC ..... *C25C 3/28* (2013.01)

(58) Field of Classification Search
CPC ..... C25C 3/28
See application file for complete search history.

(56) References Cited

U.S. PATENT DOCUMENTS 4,812,301 A * 3/1989 Davidson ..... C01B 21/06
423/411
5,227,195 A * 7/1993 Sanjurjo ..... B22F 9/30
427/248.1

(Continued)

FOREIGN PATENT DOCUMENTS

CN 100415940 C 9/2008
CN 101519789 A 9/2009

(Continued)

OTHER PUBLICATIONS

Qiuyu Wang et al., "Producing metallic titanium through electrorefining of titanium nitride anode" Electrochemistry Communications, vol. 35, 2013, pp. 135-138.

(Continued)

*Primary Examiner* — Bryan D. Ripa
(74) *Attorney, Agent, or Firm* — Novick, Kim & Lee, PLLC; Allen Xue

(57) ABSTRACT

The present invention provides a method for electrowinning a titanium metal from a titanium-containing soluble anode molten salt, and relate to the technical field of nonferrous metallurgy. The method comprises: mixing a titanium-containing material and a carbon-containing reducing agent at a mol ratio of 5:1-1:20 as a raw material, press-molding after uniformly mixing, holding a temperature range of 1000° C.-2000° C. under a nitrogen-containing atmosphere, reacting for 30-600 min; preparing a titanium-containing compound with a good electrical conductivity; and then electrowinning a titanium metal in a halide molten salt of an alkali metal or alkaline earth metal by using such a titanium-containing compound as an anode. The method for electrowinning a titanium metal from a titanium-containing soluble anode molten salt, provided by the present invention, is a simple in process and low in energy consumption, and (Continued)

can realize industrialized preparation of a high-purity titanium metal.

14 Claims, 7 Drawing Sheets

(56) References Cited

U.S. PATENT DOCUMENTS

| | | | | |
|---|---|---|---|---|
| 5,942,097 | A * | 8/1999 | Rapp | C25C 3/06 204/246 |
| 2004/0194574 | A1* | 10/2004 | Cardarelli | C25C 3/00 205/398 |
| 2005/0166706 | A1* | 8/2005 | Withers | C22B 34/1281 75/10.23 |
| 2016/0155814 | A1* | 6/2016 | Ogawa | C09D 11/52 257/288 |

FOREIGN PATENT DOCUMENTS

| | | | |
|---|---|---|---|
| CN | 101914788 | A | 12/2010 |
| GB | 795386 | A | 5/1958 |
| GB | 795416 | A | 5/1958 |

OTHER PUBLICATIONS

Zheng-Ping Li et al., "Carbon-Thermal Reduction Nitridation of Blast Furnace Slag Bearing Titanium", Journal of Iron and Steel Research, vol. 17, No. 3, Jun. 2005, pp. 15-29.

* cited by examiner

METHOD FOR ELECTROWINNING TITANIUM FROM TITANIUM-CONTAINING SOLUBLE ANODE MOLTEN SALT

TECHNICAL FIELD

The present invention belongs to the technical field of nonferrous metallurgy, and particularly relates to a method for electrowinning titanium from a titanium-containing soluble anode molten salt.

BACKGROUND

Titanium metal has advantages of small density, high specific strength, corrosion resistance, high temperature resistance, non magnetism, non toxicity and the like; and a titanium alloy has a memory function, a super-conduction function, a hydrogen storage function and the like. At present, the titanium metal has been widely applied to military fields such as aerospace and war industry as well as civil fields such as chemical engineering, marine, automotive, sporting equipment, medical instruments, architecture and the like, and is honored as a "future metal", a "third metal".

At present, a prevailing production process of the titanium metal is a Kroll method, that is, an aluminothermic reduction method of titanium tetrachloride. Its core process comprises: placing a magnesium metal in a reactor and flushing with argon gas for protection, heating to 800° C.-900° C., and then adding the titanium tetrachloride at a certain speed to react with molten magnesium metal to prepare titanium sponge, wherein a purity of the titanium is about 99.7%. Its metallurgical production process is complicated and cumbersome in flow, and high large in energy consumption and cost, such that its price may not be lowered. The titanium metal is high in price for these reasons, which greatly limits the application of the titanium metal.

In 2000, D. J. Fray of University of Cambridge, UK, proposed a process for producing titanium sponge through cathode deoxidization in molten $CaCl_2$ by using $TiO_2$ as a raw material (WO09963638). Its process has the following characteristics: (1) low electrolysis deoxidization efficiency; (2) complicated deoxidization procedure; (3) relatively high requirement for a purity of a titanium oxide raw material. Accordingly, an industrialized procedure of the FFC process also requires a relatively long period to try to address the above problem, and it is undesirable that the Kroll method is replaced by this method to produce the titanium metal within a short period.

A research group of D. Sadoway of Massachusetts Institute of Technology prepared a liquid titanium metal by electrolyzing a $TiO_2$-containing oxide melt at 1700° C. This process is simple, is capable of realizing continuous production, and produces $O_2$ at an anode, which is free of pollution to an environment. However, since an operating temperature of this process is 1700° C., there is a need for a precious metal material as its anode, resulting in high cost. In addition, liquid titanium prepared by electrolyzing the melt titanium dioxide is deposited on a bottom of an electrolytic cell to be in direct contact with a high-temperature molten salt layer containing oxygen ions, which typically causes a problem of high oxygen content of a product, so far, the oxygen content of the titanium metal obtained by such a method is greater than 2%, which differs too much from a quality requirement of an available titanium metal. Therefore, at present, it is still undesirable that the environmental titanium is directly electrolyzed by such a method.

A research of Okabe and Ono of Kyoto University was as follows: in a $CaCl_2$ molten salt, titanium dioxide was reduced with activated calcium obtained by electrolysis into a titanium metal. It differs from the FFC process of University of Cambridge in that the titanium metal is obtained by reducing $TiO_2$ with a calcium metal obtained by electrolysis, rather than directly by titanium dioxide cathode deoxidization. Also, this process has problems similar to those of the FFC process of University of Cambridge, such as low current efficiency, high oxygen content for product quality, high requirement for a purity of a titanium dioxide raw material, and the like.

In the 1950s, E. Wainer made a research as follows: TiC and TiO which served as raw materials were thermally treated at a high temperature of 2100° C. after mixed to form a solid solution (TiC—TiO), and the solid solution which served as an anode was electrolyzed in a chloride molten salt, he found that a CO gas was emitted from the anode and there was no remaining product (anode mud) in an anode region, and the solid solution might be deposited at a cathode after electrolyzed for a long time to obtain pure titanium. However, there was a need for TiC and TiO as raw materials for a scheme proposed by Wainer, wherein TiO was hardly prepared and controlled, and the solid solution of the TiC and the TiO was prepared under a condition of a high electric arc melting temperature (>2100° C.); thus problems are evident in an actual application.

Y. Hashimoto as a research worker in Japan made a research as follows: excessive carbon and $TiO_2$ which served as raw materials were mixed, and prepared into oxygen doped TiC by employing a high electric arc temperature (>1700° C.), and the oxygen doped TiC which served as an anode was electrolyzed in a molten salt, and deposited at a cathode to obtain pure titanium. However, a preparation procedure of the anode was always dependent on a very high-temperature (>1700° C.) reduction condition, and did not essentially achieve the purpose of extracting titanium at a low cost, and his electrolysis experiments all predominantly used low-oxygen titanium carbide, and a large amount of anode mud was produced due to too high carbon content of the anode, such that continuous electrolysis might not be normally conducted.

MER in USA developed a novel electroreduction process (WO2005/019501). This process is as follows: $TiO_2$ and C were mixed in a stoichiometric ratio, and thermally reduced at 1100° C.-1300° C. to obtain a composite of a low valence oxide of titanium and carbon, and the composite served as a composite anode was electrolyzed in an alkali metal molten salt system to obtain a titanium metal. In this process, the composite anode was a mixed material of the low valence oxide of titanium and the carbon, anode mud and residual carbon might be in an electrochemical dissolution procedure, and thus a problem of short-circuiting between electrodes might be caused as an amount of residual carbon increases and a product might be polluted.

In 2005, D. Hong-Min Zhu of University of Science and Technology Beijing proposed a novel process for winning and smelting clean titanium (ZL200510011684.6), which is as follows: titanium dioxide and graphite which served as raw materials were subjected to carbothermal reduction in vacuum at 1500° C. to prepare a $Ti_2CO$ with good electrical conductivity, and the $Ti_2CO$ which served as a soluble anode material was electrolyzed in a NaCl—KCl molten salt system at 700° C. to win a high-purity titanium metal, and the high-purity titanium, with carbon and oxygen contents both less than 300 ppm, was obtained on a cathode. A scientific and mechanism problem had been intensively studied in this process, and small-scale intermediate experiments were conducted, which proved its feasibility.

Panzhihua Steel, Sichuan, applied a method for electrowinning a titanium metal from a titanium cyclic molten salt (CN 101519789A) in 2009, which is as follows: titanium tetrachloride which served as a raw material was reduced to a low valence chloride of titanium by using the titanium metal, and then the titanium metal is obtained by molten salt electrolysis. The method had the following problems: prices of the titanium tetrachloride and the titanium metal which served as the raw materials are high, and a reaction rate of reducing the titanium tetrachloride to the low valence titanium is low, which also resulted in high production cost of the titanium. Panzhihua Steel, Sichuan, applied a method for preparing a titanium metal (CN 101914788) in 2010, which is as follows: excessive carbon was directly proportioned when titanium slag is smelted from a titanium concentrate, then nitrogen was introduced to prepare titanium nitride or titanium carbonitride, and the titanium nitride or titanium carbonitride was electrolyed to obtain the titanium metal. In this method, the excessive carbon was proportioned to prepare the titanium nitride or titanium carbonitride. The method had the following problems: (1) due to excessive carbon proportioned in, there was residual carbon in preparing the titanium nitride or titanium carbonitride; (2) carbon therein may be separated out in a form of elemental carbon to become residual carbon during long-term electrolysis when the titanium nitride or titanium carbonitride served as the anode; the residual carbon produced in the above two cases might pollute a quality of a product at a cathode, and easily caused problems of short circuiting between electrodes, low current efficiency, high carbon content of the product, and the like.

SUMMARY

An objective of the present invention is to overcome shortcomings that a method for preparing a titanium metal in the prior art is long in flow and high in energy consumption, with a product quality falling out of a standard of high-purity titanium or failing of realizing industrialization. Accordingly, the present invention provides a method capable of realizing industrialized preparation of a high-purity titanium metal, which is simple in process and low in energy consumption.

In view of the prior art, improved contents of the present invention are embodied in that: (1) titanium compounds ($TiC_xO_yN_z$, $TiO_xN_y$, $TiN_x$) with a metal electrical conductivity are synthesized and prepared at a low cost; (2) a pure titanium metal is won through molten salt electrolysis by using the titanium compounds ($TiC_xO_yN_z$, $TiO_xN_y$, $TiN_x$) as an anode material; (3) in an electrolysis procedure, titanium in titanium-containing compounds ($TiC_xO_yN_z$, $TiO_xN_y$, $TiN_x$) is dissolved in an electrolyte in a form of titanium ions, wherein carbon, oxygen and nitrogen are separated out in forms of CO, $CO_2$ and $N_2$, without causing a problem of residual carbon at an anode; (4) a raw material and a product are respectively on the anode and a cathode, which ensures that the product is not influenced by impurities in the raw material; meanwhile, the molten salt electrolysis per se has a refining procedure, this process combines winning titanium and refining titanium into one, and the high-purity titanium metal is directly obtained on the cathode; (5) the raw material and the product are respectively on the anode and the cathode, and the continuous production may be realized by continuously replacing electrodes. By integrating the above improved contents, compared with the prior art, the present invention has the advantages of short process flow, high carbothermal reduction efficiency, less intermediate products, direct availability of the high-purity titanium metal, low requirement for a purity of the anode raw material, low energy consumption, environmental friendliness and the like.

An objective of the present invention is to provide a method for electrowinning titanium from a titanium soluble anode molten salt, comprising the following steps:

(1) mixing a titanium-containing material and a carbon-containing reducing agent at a mol ratio of 5:1-1:20 as a raw material, press-molding after uniformly mixing, holding a temperature range of 1000° C.-2000° C. under a nitrogen-containing atmosphere, reacting for 30-600 min; preparing a titanium-containing compound with a good electrical conductivity; wherein the titanium-containing material comprises one or more of rutile type titanium white, anatase type titanium white, metatitanic acid, ilmenite, vanadium titanomagnetite, blast furnace type high-titanium slag, high-titanium slag and low valence oxides of titanium; the carbon-containing reducing agent comprises one or more of carbon, activated carbon, graphite powder, charcoal, petroleum coke, asphalt and coal coke particulate; the prepared titanium-containing compound is one or more of $TiC_xO_yN_z$, $TiO_xN_y$ and $TiN_x$, a mol ratio of carbon to oxygen to nitrogen of the $TiC_xO_yN_z$ conforms to the following rule: $0<X\leq Y<1$, $0<Z<1$ and $X+Y+Z=1$; a mol ratio of oxygen to nitrogen of the $TiO_xN_y$ conforms to the following rule: $0<X\leq Y$ and $X+Y=1$; and a mol ratio of nitrogen of the $TiN_x$ conforms to the following rule: $0<X\leq 1$;

(2) preparing an electrode by using the titanium-containing compound obtained in the step (1) as a raw material, electrowinning a titanium metal in a halide molten salt of an alkali metal or alkaline earth metal, wherein its anode is formed by the prepared titanium-containing compound, and the titanium metal is obtained on a cathode; the cathode is formed by one or more of titanium metal, stainless steel, carbon steel, molybdenum metal and nickel metal; a space between the cathode and the anode is controlled to between 1 cm and 50 cm; an electrolyte consists of an alkali metal or alkaline earth metal halide; a cell voltage is controlled to 0.5 V-10.0 V, an anode current density ranges from 0.05 A/cm$^2$ to 1.50 A/cm$^2$, a cathode current density ranges from 0.05 A/cm$^2$ to 1.50 A/cm$^2$, and an electrolysis temperature ranges from 300° C. to 1000° C.

Further, the nitrogen-containing atmosphere comprises one or more of air, nitrogen, ammonia, nitrogen-hydrogen, nitrogen-argon and a mixed gas of other nitrogen-containing gases.

Further, the low valence oxide of titanium is one or more of $Ti_2O_3$, $Ti_3O_5$, TiO and $Ti_3O$.

Preferably, a titanium-containing compound with an electrical conductivity is prepared under a closed system or semi-open system or open system of a nitrogen-containing atmosphere.

Preferably, the closed system is a system of a nitrogen-containing atmosphere under a partially positive pressure or normal pressure (one standard atmospheric pressure) or partially vacuum.

Further, the electrolyte utilizes a mixed salt of one or more of $CsCl_2$, $CaCl_2$, LiCl, NaCl, KCl, $MgCl_2$, $AlCl_3$, CaF, NaF, KF and LiF and one or more of $TiCl_3$, $TiCl_2$, $K_2TiF_6$ and $Na_2TiF_6$ as a molten salt electrolyte system, wherein a mass percent concentration of Ti ions in the molten salt electrolyte system is 1%-10%.

Further, a mol ratio of the titanium-containing material to the carbon-containing reducing agent is 5:1-1:10.

Preferably, the electrolysis temperature ranges from 400° C. to 900° C.

Preferably, a space between the cathode and the anode is controlled to between 3 cm and 40 cm; a cell voltage is controlled to 1.5 V-6.0 V. An anode current density ranges from 0.05 $A/cm^2$ to 1.00 $A/cm^2$, and a cathode current density ranges from 0.05 $A/cm^2$ to 1.00 $A/cm^2$.

Further, a container for the electrolyte is one of a stainless steel crucible, a carbon steel crucible, a titanium crucible, a titanium alloy crucible, a graphite crucible, a molybdenum crucible or a nickel crucible.

DETAILED DESCRIPTION

Figure 1A:
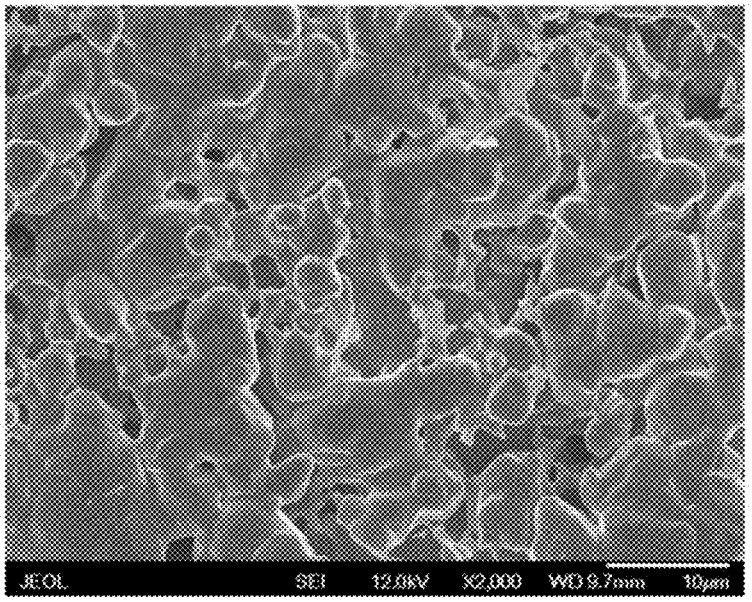
FIG. 1*a* is a SEM schematic view of an anode block body after thermal treatment according to an embodiment 1 of the present invention.

The detailed description of the present invention will be further explained below in connection with exemplary embodiments, and is not intended to limit the present invention within a scope of the described exemplary embodiments. A carbonaceous reducing agent in the present invention refers to a reducing agent with carbon as a major component, for example, carbon, activated carbon, graphite powder, charcoal, petroleum coke, asphalt and coal coke particulate.

A method for electrowinning titanium from a titanium compound soluble anode molten salt according to an exemplary embodiment comprises the following steps:

(1) mixing a titanium-containing material and a carbon-containing reducing agent at a mol ratio of 5:1-1:20 as a raw material, press-molding after uniformly mixing, holding a temperature range of 1000° C.-2000° C. under a nitrogen-containing atmosphere, reacting for 30-600 min; preparing a titanium-containing compound with a good electrical conductivity; wherein the titanium-containing material comprises one or more of rutile type titanium white, anatase type titanium white, metatitanic acid, ilmenite, vanadium titano-magnetite, blast furnace type high-titanium slag, high-titanium slag and low valence oxides of titanium; the carbon-containing reducing agent comprises one or more of carbon, activated carbon, graphite powder, charcoal, petroleum coke, asphalt and coal coke particulate; the prepared titanium-containing compound is one or more of $TiC_xO_yN_z$, $TiO_xN_y$ and $TiN_x$, a mol ratio of carbon to oxygen to nitrogen of the $TiC_xO_yN_z$ conforms to the following rule: $0<X\leq Y<1$, $0<Z<1$ and $X+Y+Z=1$; a mol ratio of oxygen to nitrogen of the $TiO_xN_y$ conforms to the following rule: $0<X\leq Y$ and $X+Y=1$; and a mol ratio of nitrogen of the $TiN_x$ conforms to the following rule: $0<X\leq 1$;

(2) preparing an electrode by using the titanium-containing compound obtained in the step (1) as a raw material, electrowinning a titanium metal in a halide molten salt of an alkali metal or alkaline earth metal, wherein its anode is formed by the prepared titanium-containing compound, and the titanium metal is obtained on a cathode; the cathode is formed by one or more of titanium metal, stainless steel, carbon steel, molybdenum metal and nickel metal; a space between the cathode and the anode is controlled to between 1 cm and 50 cm; an electrolyte consists of an alkali metal or alkaline earth metal halide; a cell voltage is controlled to 0.5 V-10.0 V, an anode current density ranges from 0.05 $A/cm^2$ to 1.50 $A/cm^2$, a cathode current density ranges from 0.05 $A/cm^2$ to 1.50 $A/cm^2$, and an electrolysis temperature ranges from 300° C. to 1000° C.

In the method for electrowinning titanium from a titanium compound ($TiC_xO_yN_z$, $TiO_xN_y$, $TiN_x$) soluble anode molten salt according to an exemplary embodiment, a titanium-containing material comprises one or more of rutile type titanium white, anatase type titanium white, metatitanic acid, ilmenite, vanadium titano-magnetite, blast furnace type high-titanium slag, high-titanium slag and low valence oxides of titanium ($Ti_2O_3$, $Ti_3O_5$, TiO, $Ti_3O$); a carbon-containing reducing agent comprises materials mainly containing carbon, such as carbon, activated carbon, graphite powder, charcoal, petroleum coke, asphalt and coal coke particulate; a mol ratio of the titanium-containing material to the carbon-containing reducing agent may be set to 5:1-1:20; if the mol ratio is less than 5:1, then a product contains a large amount of low valence oxides of titanium; if the mol ratio is greater than 1:20, then there may be a large amount of residual carbon, so the mol ratio is preferably 5:1-1:10; the titanium compound ($TiC_xO_yN_z$, $TiO_xN_y$, $TiN_x$) is prepared under the nitrogen-containing atmosphere; a temperature at which the titanium compound ($TiC_xO_yN_z$, $TiO_xN_y$, $TiN_x$) is prepared ranges from 1000° C. to 2000° C.; a space between a cathode and an anode is controlled to 1 cm-50 cm, here, if the space between the cathode and the anode is less than 1 cm, then short circuiting may be easily caused between the cathode and the anode; if the space between the cathode and the anode is greater than 50 cm, a cell voltage is overhigh, so the space preferably ranges from 3 cm to 40 cm; an electrolyte is formed by an alkali metal or alkaline earth metal halide, or formed by an alkali metal or alkaline earth metal oxide, or formed by an alkali metal or alkaline earth metal halide and an alkaline earth metal oxide; the cell voltage may be set to 0.5 V-10.0 V, if the cell voltage of the anode is lower than 0.5 V, an electrolyzing rate of the anode is low, which results in low daily output; if the cell voltage of the anode is higher than 10.0 V, overhigh overpotential may be caused, and the anode is easily mechanically crushed, resulting in increased energy consumption and low anode current efficiency, so the cell voltage is preferably set to 1.5 V-6.0 V; the anode current density may be set to 0.05 $A/cm^2$-1.50 $A/cm^2$, preferably, 0.05 $A/cm^2$-1.00 $A/cm^2$; the cathode current density may be set to 0.05 $A/cm^2$-1.50 $A/cm^2$, preferably, 0.05 $A/cm^2$-1.00 $A/cm^2$; a container for the electrolyte is one of a stainless steel crucible, a carbon steel crucible, a titanium crucible, a titanium alloy crucible, a graphite crucible, a molybdenum crucible or a nickel crucible.

Hereinafter, specific embodiments of the method for electrowinning titanium from a titanium-containing soluble anode molten salt will be given, which are merely exemplary, and the present invention is not limited to thereto.

Embodiment 1

Figure 1B:
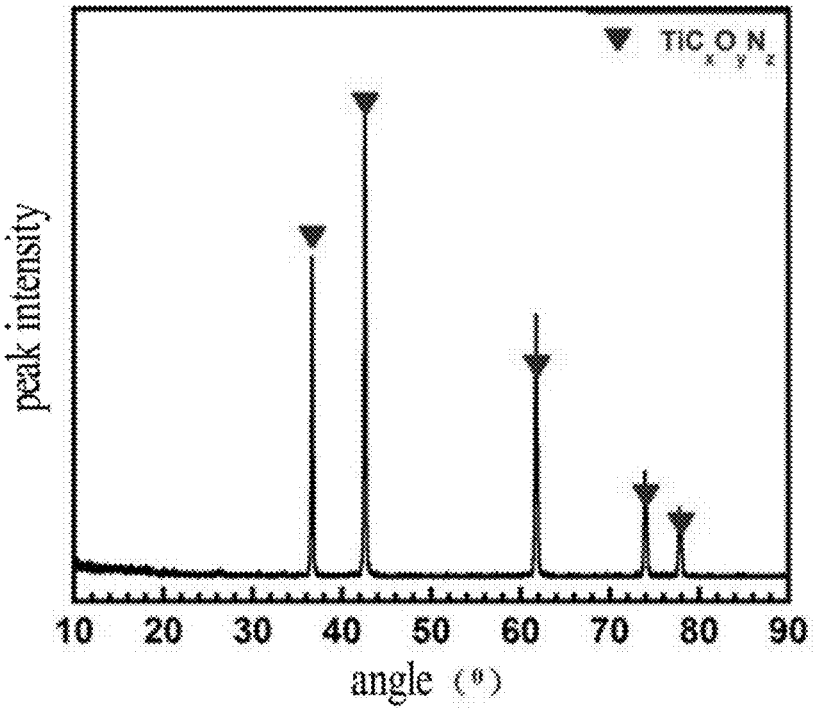
FIG. 1*b* is an X ray diffraction pattern of an anode block body after thermal treatment according to an embodiment 1 of the present invention.

80.2 g of titanium white ($TiO_2$ 99.5 wt %) and 21.0 g of graphite powder (C content 99.9%) were weighed, uniformly mixed in a star type ball mill, and press-molded at a pressure of 10 MP; a block body was placed in a closed normal-pressure heating furnace, heated to 1500° C. under a $N_2$—$H_2$ mixed atmosphere and held for 120 min, wherein it was found that a reaction rate was 98.3% by calculating a weight loss rate, a structure and a composition of a product were analyzed by XRD, as shown in FIG. 1*a* and FIG. 1*b* of the description, an original mixed phase of titanium dioxide and graphite powder was transformed into a single titanium compound ($TiC_xO_yN_z$) phase, it was seen from a SEM view that the product has a size of about 10 μm. A conductivity of a press-molded block body was sharply reduced to 0.005 ohm·cm from an original 15-25 ohm·cm. A NaCl—KCl—$TiCl_2$ salt was contained by using a graphite crucible, wherein a mass percent concentration of Ti ions was 5%; an electrolysis experiment was conducted at 700° C. The prepared titanium compound ($TiC_xO_yN_z$) served as an anode, with an anode current density of 0.1 A/cm$^2$, online monitoring was conducted on a gas composition at the anode by using an online high-sensitivity gas sampling system and a mass spectrometer to analyze that gases emitted from the anode are $N_2$, $CO_2$ and CO, a carbon steel electrode was selected as a cathode, with a cathode current density of 0.1 A/cm$^2$, a constant current electrolysis was conducted, a space between the cathode and the anode was controlled to 3 cm, the anode and the cathode were taken out after 5 h and then an electrolyte on surfaces of the cathode and the anode was cleaned respectively by using 1 wt % diluted hydrochloric acid, then chloride ions were cleaned with deionized water, then the cathode and the anode were dried, and the above experiment was repeated for 5 times. Current efficiencies of the anode and the cathode were respectively calculated as 97.8% and 94.8%, a structure and a composition of the product were analyzed by XRD, this product was a single phase of the titanium metal, and carbon, oxygen and nitrogen contents of the product were analyzed, respectively 30 ppm, 150 ppm and 120 ppm.

Embodiment 2

Figure 2:
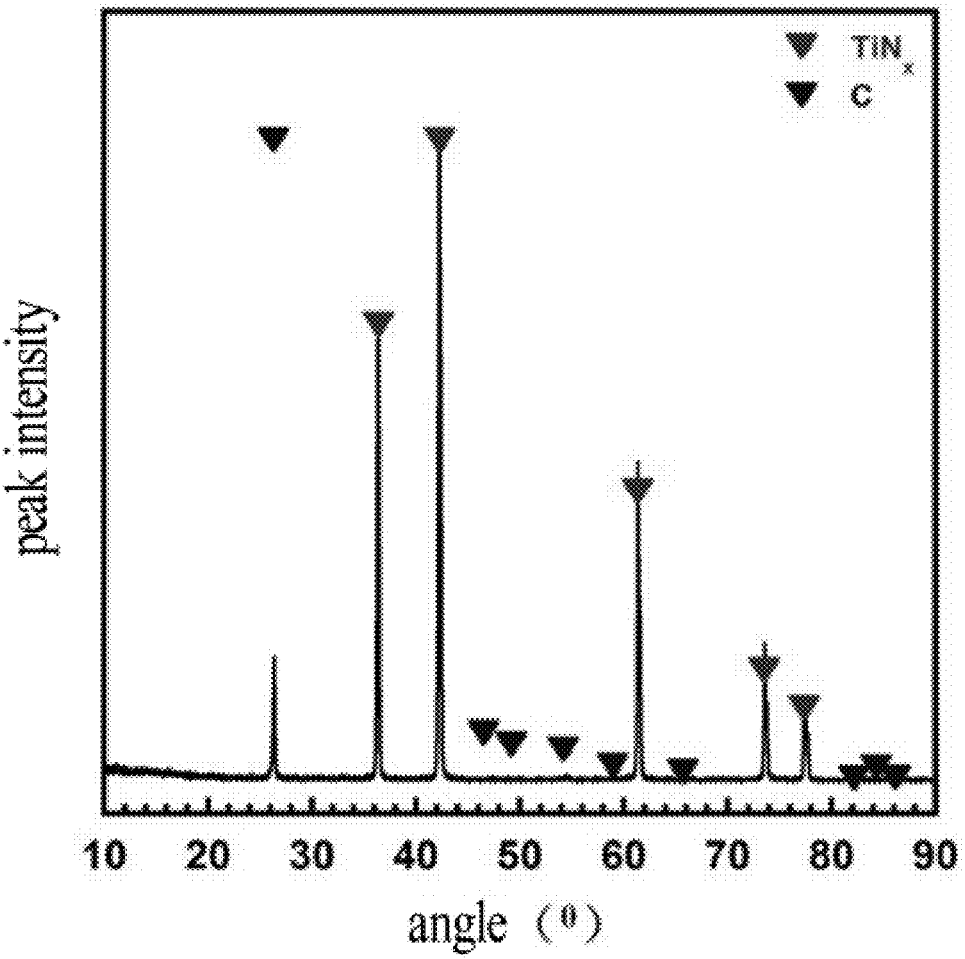
FIG. 2 is an X ray diffraction pattern of a reaction product obtained after thermal treatment according to an embodiment 2 of the present invention.

80.2 g of titanium white ($TiO_2$ 99.5 wt %) and 120.0 g of graphite powder (C content 99.9%) were weighed, uniformly mixed in a star type ball mill, and press-molded at a pressure of 30 MP; a block body was placed in a closed normal-pressure heating furnace, heated to 1400° C. under a $N_2$ atmosphere and held for 60 min, wherein it was found that a reaction rate was 99.2% by calculating a weight loss rate, a structure and a composition of a product were analyzed by XRD, as shown in FIG. 2 of the description, an original mixed phase of titanium monoxide and graphite powder was transformed into a mixed phase of a titanium compound (TiNx) and C. A conductivity of a press-molded block body was sharply reduced to 0.003 ohm·cm from an original 15-25 ohm·cm. A NaCl—KCl—$TiCl_3$ salt was contained by using a molybdenum crucible, wherein a mass percent concentration of Ti ions was 3.0%; an electrolysis experiment was conducted at 750° C. The prepared titanium compound ($TiN_x$) and C served as an anode, with an anode current density of 0.15 A/cm$^2$, online monitoring was conducted on a gas composition at the anode by using an online high-sensitivity gas sampling system and a mass spectrometer to analyze that a gas emitted from the anode is $N_2$. A stainless steel electrode was selected as a cathode, with a cathode current density of 0.15 A/cm$^2$, a constant current electrolysis was conducted, a space between the cathode and the anode was controlled to 5 cm, the anode and the cathode were taken out after 5 h and then an electrolyte on surfaces of the cathode and the anode was cleaned respectively by using 1 wt % diluted hydrochloric acid, then chloride ions were cleaned with deionized water, and then the cathode and the anode were dried. Current efficiencies of the anode and the cathode were respectively calculated as 87.4% and 76.5%, a structure and a composition of the product were analyzed by XRD, this product was a single phase of the titanium metal, and carbon and oxygen contents of the product were analyzed, respectively 250 ppm and 245 ppm.

Embodiment 3

Figure 3:
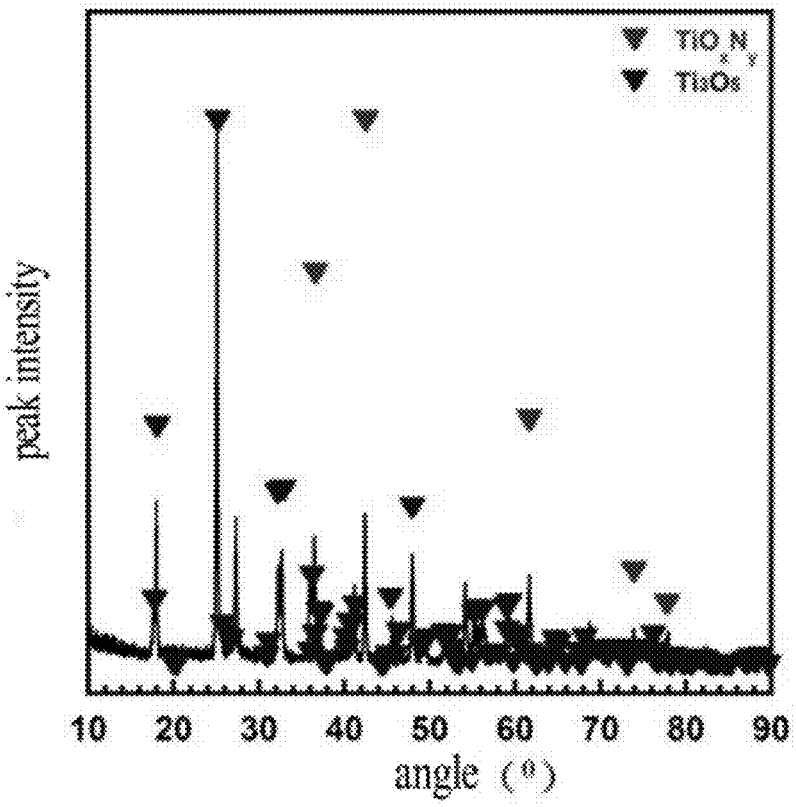
FIG. 3 is an X ray diffraction pattern of a reaction product obtained after thermal treatment at 1500° C. according to an embodiment 3 of the present invention.

80.2 g of titanium white ($TiO_2$ 99.5 wt %) and 6.0 g of graphite powder (C content 99.9%) were weighed, uniformly mixed in a star type ball mill, and press-molded at a pressure of 50 MP; a block body was placed in a semi-open heating furnace, heated to 1600° C. in air and held for 90 min, wherein it was found that a reaction rate was 98.5% by calculating a weight loss rate, a structure and a composition of a product were analyzed by XRD, as shown in FIG. 3 of the description, an original mixed phase of titanium dioxide and graphite powder was transformed into a mixed phase of a titanium compound ($TiO_xN_y$) and $Ti_3O_5$, a conductivity of a press-molded block body was sharply reduced to 0.18 ohm·cm from an original 165-175 ohm·cm. A NaCl—KCl—$TiCl_2$—$TiCl_3$ salt was contained by using a nickel crucible, wherein a mass percent concentration of Ti ions was 8%; an electrolysis experiment was conducted at 800° C. A mixed phase of the prepared titanium compound ($TiO_xN_y$) and $Ti_3O_5$ served as an anode, with an anode current density of 0.25 A/cm$^2$. A molybdenum metal was selected as a cathode, with a cathode current density of 0.25 A/cm$^2$, a constant current electrolysis was conducted, a space between the cathode and the anode was controlled to 8 cm, the anode and the cathode were taken out after 5 h and then an electrolyte on surfaces of the cathode and the anode was cleaned respectively by using 1 wt % diluted hydrochloric acid, then chloride ions were cleaned with deionized water, then the cathode and the anode were dried, and the above experiment was repeated for 5 times. Current efficiencies of the anode and the cathode were respectively calculated as 74.2% and 63.4%, a structure and a composition of the product were analyzed by XRD, this product was a single phase of the titanium metal, and oxygen and nitrogen contents of the product were analyzed, respectively 228 ppm and 285 ppm.

Embodiment 4

80.2 g of titanium white ($TiO_2$ 99.5 wt %) and 28.0 g of petroleum coke (C content 89.0%) were weighed, mixed according to the embodiment 1, and press-molded; a block body was placed in a closed normal-pressure heating furnace under a condition of a micro-negative pressure, heated to 1500° C. under a $N_2$ atmosphere and held for 120 min, wherein it was found that a reaction rate was 97.6% by calculating a weight loss rate, a structure and a composition of a product were analyzed by XRD, an original mixed phase of metatitanic acid and graphite powder was transformed into a single titanium compound ($TiC_xO_yN_z$) phase. A conductivity of a press-molded block body was sharply reduced to 0.015 ohm·cm from an original 75-85 ohm·cm. A NaF—KF—$K_2TiF_6$ salt was contained by using a titanium crucible, wherein a mass percent concentration of Ti ions was 5%; an electrolysis experiment was conducted at 800° C. The prepared titanium compound ($TiC_xO_yN_z$) served as an anode, with an anode current density of 0.3 A/cm$^2$, online monitoring was conducted on a gas composition at the anode by using an online high-sensitivity gas sampling system and a mass spectrometer to analyze that gases emitted from the anode are $N_2$, $CO_2$ and CO, nickel was selected as a cathode, with a cathode current density of 0.3 A/cm$^2$, a constant current electrolysis was conducted, a space between the cathode and the anode was controlled to 3 cm, the anode and the cathode were taken out after 5 h and then an electrolyte on surfaces of the cathode and the anode was cleaned respectively by using 1 wt % diluted hydrochloric acid, then chloride ions were cleaned with deionized water, then the cathode and the anode were dried, and the above experiment was repeated for 5 times. Current efficiencies of the anode and the cathode were respectively calculated as 95.3% and 93.5%, a structure and a composition of the product were analyzed by XRD, this product was a single phase of the titanium metal, and carbon, oxygen and nitrogen contents of the product were analyzed, respectively 50 ppm, 175 ppm and 135 ppm.

Embodiment 5

Figure 4:
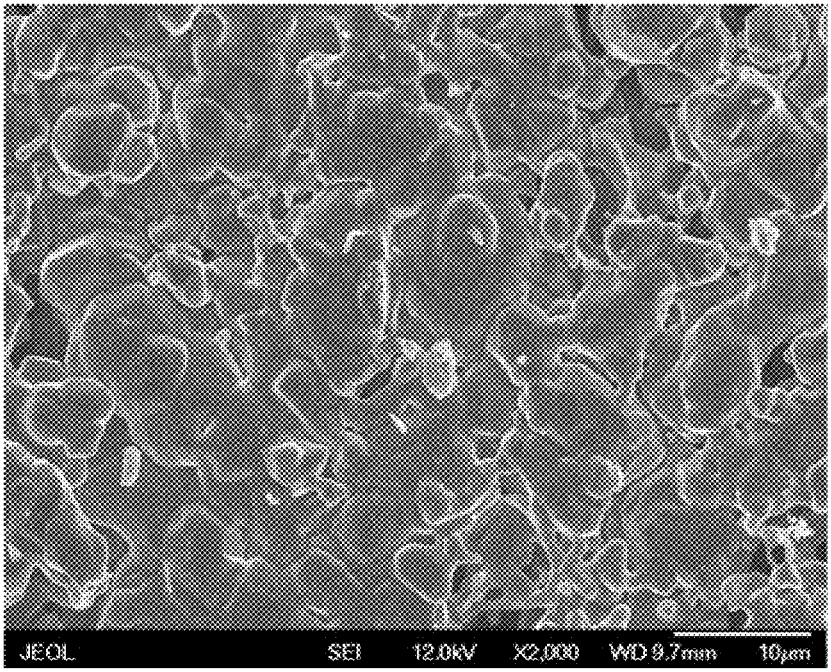
FIG. 4 is a SEM schematic view of an anode block body after thermal treatment according to an embodiment 5 of the present invention.

80.2 g of titanium white ($TiO_2$ 99.5 wt %) and 35.0 g of charcoal (C content 75.0%) were weighed, mixed according to the embodiment 1, and press-molded; a block body was placed in a closed normal-pressure heating furnace, heated to 1300° C. under a $N_2$ atmosphere and held for 300 min, wherein it was found that a reaction rate was 97.8% by calculating a weight loss rate, a structure and a composition of a material were analyzed by XRD after thermal treatment, an original mixed phase of titanium dioxide and carbon was transformed into a single titanium compound ($TiC_xO_yN_z$) phase. It could be seen from FIG. 4 of the description that a product with a size of about 10 μm was obtained. A conductivity of a press-molded block body was sharply reduced to 0.018 ohm·cm from an original 95-105 ohm·cm. A LiCl—KCl—$TiCl_2$ salt was contained by using a nickel crucible, wherein a mass percent concentration of Ti ions was 8%; an electrolysis experiment was conducted at 450° C. The prepared titanium compound ($TiC_xO_yN_z$) served as an anode, with an anode current density of 0.45 A/cm$^2$, online monitoring was conducted on a gas composition at the anode by using an online high-sensitivity gas sampling system and a mass spectrometer to analyze that gases emitted from the anode are $N_2$, $CO_2$ and CO, titanium was selected as a cathode, with a cathode current density of 0.45 A/cm$^2$, a constant current electrolysis was conducted, a space between the cathode and the anode was controlled to 8 cm, the anode and the cathode were taken out after 5 h and then an electrolyte on surfaces of the cathode and the anode was cleaned respectively by using 1 wt % diluted hydrochloric acid, then chloride ions were cleaned with deionized water, then the cathode and the anode were dried, and the above experiment was repeated for 5 times. Current efficiencies of the anode and the cathode were respectively calculated as 94.7% and 93.9%, a structure and a composition of the product were analyzed by XRD, this product was a single phase of the titanium metal, and carbon, oxygen and nitrogen contents of the product were analyzed, respectively 45 ppm, 228 ppm and 185 ppm.

Embodiment 6

99.8 g of metatitanic acid ($TiO(OH)_2$ 98.0 wt %) and 24.0 g of graphite powder (C content 99.9%) were weighed, mixed according to the embodiment 1, and press-molded; a block body was placed in a closed micro-positive-pressure heating furnace, heated to 1450° C. under a $NH_3$ atmosphere and held for 480 min, wherein it was found that a reaction rate was 99.2% by calculating a weight loss rate, a structure of a material was analyzed by XRD after thermal treatment, an original mixed phase of metatitanic acid and carbon was transformed into a single titanium compound ($TiC_xO_yN_z$) phase. A conductivity of a press-molded block body was sharply reduced to 0.001 ohm·cm from an original 45-55 ohm·cm. A LiCl—KCl—$TiCl_3$ salt was contained by using a titanium alloy crucible, wherein a mass percent concentration of Ti ions was 7%; an electrolysis experiment was conducted at 450° C. The prepared titanium compound ($TiC_xO_yN_z$) served as an anode, with an anode current density of 0.5 A/cm$^2$, online monitoring was conducted on a gas composition at the anode by using an online high-sensitivity gas sampling system and a mass spectrometer to analyze that gases emitted from the anode are $N_2$, $CO_2$ and CO, stainless steel is selected as a cathode, with a cathode current density of 0.5 A/cm$^2$, a constant current electrolysis was conducted, a space between the cathode and the anode was controlled to 10 cm, the anode and the cathode were taken out after 5 h and then an electrolyte on surfaces of the cathode and the anode was cleaned respectively by using 1 wt % diluted hydrochloric acid, then chloride ions were cleaned with deionized water, then the cathode and the anode were dried, and the above experiment was repeated for 5 times. Current efficiencies of the anode and the cathode were respectively calculated as 96.9% and 95.5%, the product was analyzed by XRD, this product was a single phase of the titanium metal, and carbon, oxygen and nitrogen contents of the product were analyzed, respectively 30 ppm, 180 ppm and 185 ppm.

Embodiment 7

Figure 5:
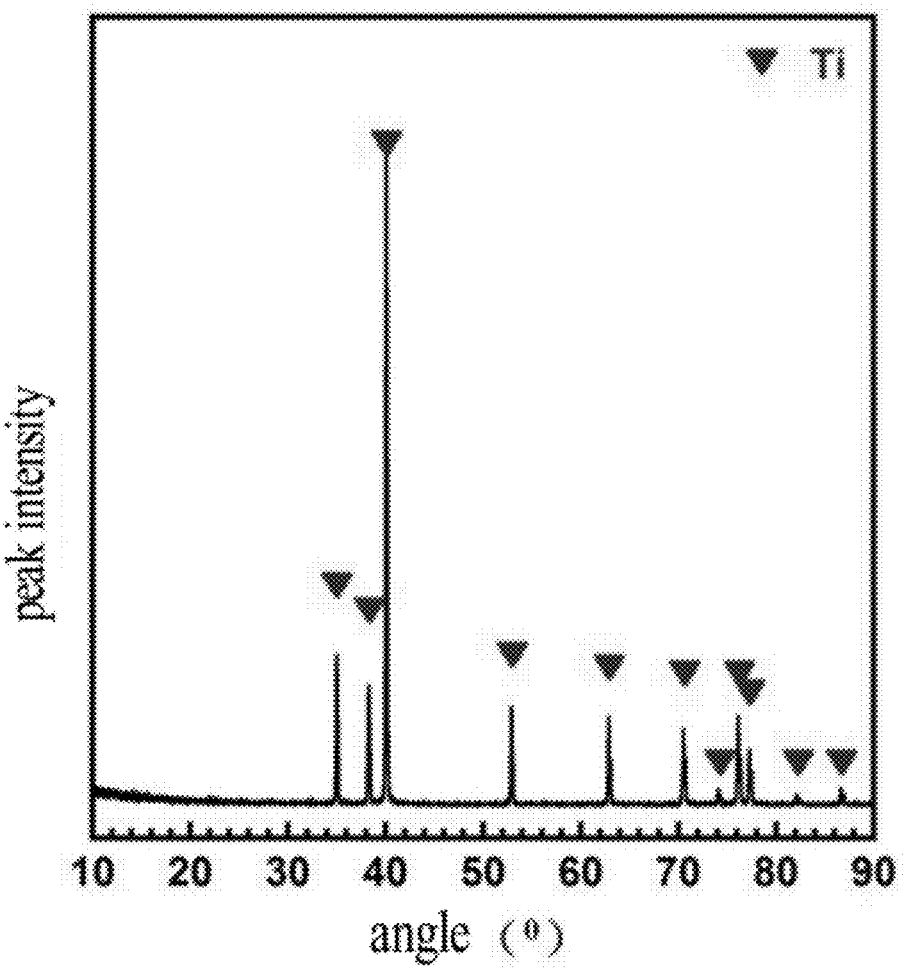
FIG. 5 is an X ray diffraction pattern of a product at a cathode according to an embodiment 7 of the present invention.

99.8 g of metatitanic acid ($TiO(OH)_2$ 98.0 wt %) and 30.0 g of petroleum coke (C content 89.0%) were weighed, mixed according to the embodiment 1, and press-molded; a block body was placed in a semi-open heating furnace, heated to 1500° C. under a $NH_3$—$N_2$ atmosphere and held for 240 min, wherein it was found that a reaction rate was 97.7% by calculating a weight loss rate, a structure and a composition of a product were analyzed by XRD, an original mixed phase of metatitanic acid and graphite powder was transformed into a single titanium compound ($TiC_xO_yN_z$) phase. A conductivity of a press-molded block body was sharply reduced to 0.015 ohm·cm from an original 85-105 ohm·cm. A $CaCl_2$—KCl—$TiCl_2$ salt was contained by using a titanium alloy crucible, wherein a mass percent concentration of Ti ions was 6%; an electrolysis experiment was conducted at 750° C. The prepared titanium compound ($TiC_xO_yN_z$) served as an anode, with an anode current density of 0.65 A/cm$^2$, online monitoring was conducted on a gas composition at the anode by using an online high-sensitivity gas sampling system and a mass spectrometer to analyze that gases emitted from the anode are $N_2$, $CO_2$ and CO, carbon steel was selected as a cathode, with a cathode current density of 0.65 A/cm$^2$, a space between the cathode and the anode was controlled to 9 cm, a constant current electrolysis was conducted, the anode and the cathode were taken out after 5 h and then an electrolyte on surfaces of the cathode and the anode was cleaned respectively by using 1 wt % diluted hydrochloric acid, then chloride ions were cleaned with deionized water, then the cathode and the anode were dried, and the above experiment was repeated for 5 times. Current efficiencies of the anode and the cathode were respectively calculated as 95.1% and 92.6%, the product was analyzed by XRD, it could be seen from FIG. 5 of the description that this product was a single phase of the titanium metal, and carbon, oxygen and nitrogen contents of the product were analyzed, respectively 65 ppm, 355 ppm and 200 ppm.

Embodiment 8

99.8 g of metatitanic acid ($TiO(OH)_2$ 98.0 wt %) and 15.0 g of charcoal (C content 75.0%) were weighed, mixed according to the embodiment 1, and press-molded; a block body was placed in a closed normal-pressure heating furnace, heated to 1100° C. under a $NH_3$—Ar atmosphere and held for 600 min, wherein it was found that a reaction rate was 95.6% by calculating a weight loss rate, a structure and a composition of a product were analyzed by XRD, an original mixed phase of metatitanic acid and charcoal was transformed into a mixed phase of titanium compounds ($TiO_xN_y$ and $TiC_xO_yN_z$). A conductivity of a press-molded block body was sharply reduced to 0.015 ohm·cm from an original 110-125 ohm·cm. A $CsCl_2$—NaCl—$TiCl_2$ salt was contained by using a titanium alloy crucible, wherein a mass percent concentration of Ti ions was 4%; an electrolysis experiment was conducted at 750° C. The prepared titanium compound ($TiC_xO_yN_z$) served as an anode, with an anode current density of 0.75 A/cm$^2$, online monitoring was conducted on a gas composition at the anode by using an online high-sensitivity gas sampling system and a mass spectrometer to analyze that gases emitted from the anode are $N_2$, $CO_2$ and CO, a titanium alloy was selected as a cathode, with a cathode current density of 0.75 A/cm$^2$, a space between the cathode and the anode was controlled to 12 cm, a constant current electrolysis was conducted, the anode and the cathode were taken out after 5 h and then an electrolyte on surfaces of the cathode and the anode was cleaned respectively by using 1 wt % diluted hydrochloric acid, then chloride ions were cleaned with deionized water, then the cathode and the anode were dried, and the above experiment was repeated for 5 times. Current efficiencies of the anode and the cathode were respectively calculated as 95.6% and 93.5%, the product was analyzed by XRD, this product was a single phase of the titanium metal, and carbon, oxygen and nitrogen contents of the product were analyzed, respectively 50 ppm, 330 ppm and 170 ppm.

Embodiment 9

Figure 6:
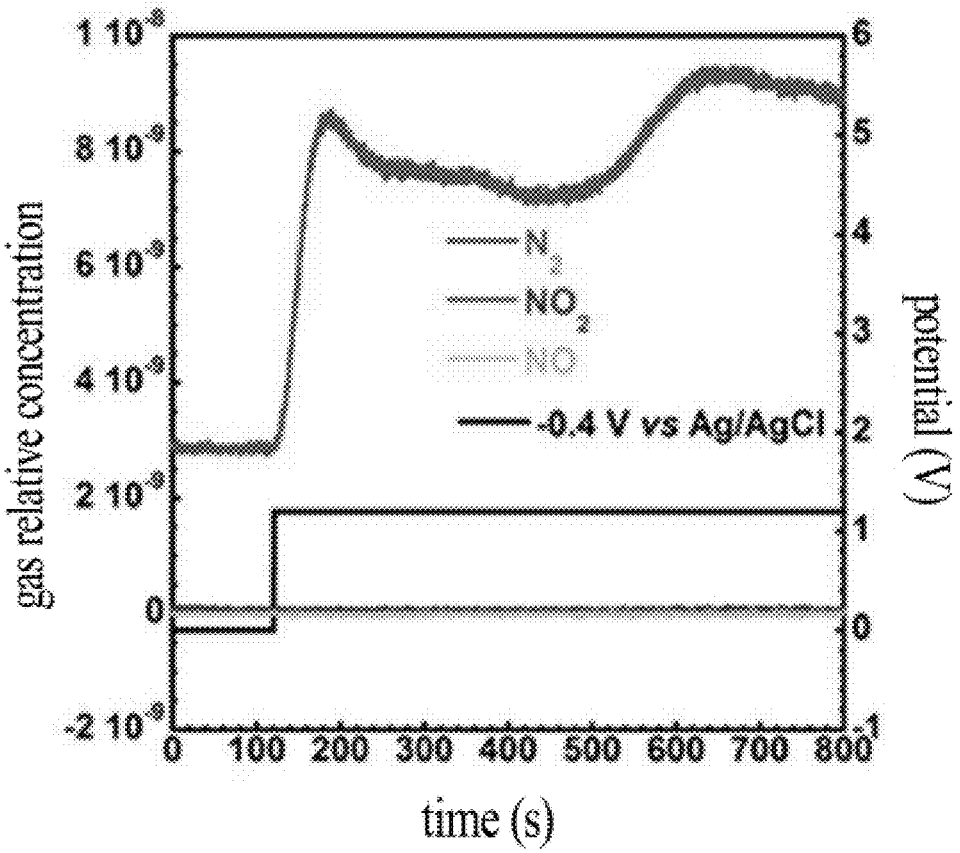
FIG. 6 is a changing curve of an anode gas in an electrolysis procedure over an electrolysis procedure according to an embodiment 9 of the present invention.

80.2 g of high-titanium slag ($TiO_2$ 89.0 wt %) and 48.0 g of graphite powder (C content 99.9%) were weighed, uniformly mixed in a star type ball mill, and press-molded at a pressure of 50 MP; a block body was placed in a closed normal-pressure heating furnace, heated to 1700° C. under a $NH_3$—$H_2$ atmosphere and held for 120 min, wherein it was found that a reaction rate was 99.6% by calculating a weight loss rate, a structure and a composition of a product were analyzed by XRD, titanium dioxide and graphite powder were transformed into a titanium compound ($TiN_x$) phase, a conductivity of a press-molded block body was sharply reduced to 0.01 ohm·cm from an original 15-25 ohm·cm. A $CaCl_2$—KCl—NaCl—$TiCl_2$ salt was contained by using a titanium alloy crucible, wherein a mass percent concentration of Ti ions was 3%; an electrolysis experiment was conducted at 750° C. The titanium compound ($TiN_x$) served as an anode, with an anode current density of 0.85 A/cm$^2$, a constant current electrolysis was conducted, and online monitoring was conducted on a gas composition at the anode by using an online high-sensitivity gas sampling system and a mass spectrometer. It could be seen from FIG. 6 of the description that a gas emitted from the anode was only $N_2$ free of NO and $NO_2$. A nickel metal was selected as a cathode, with a cathode current density of 0.85 A/cm$^2$, a space between the cathode and the anode was controlled to 15 cm, a constant current electrolysis was conducted, the anode and the cathode were taken out after 2 h and then an electrolyte on surfaces of the cathode and the anode was cleaned respectively by using 1 wt % diluted hydrochloric acid, then chloride ions were cleaned with deionized water, and then the cathode and the anode were dried. Current efficiencies of the anode and the cathode were respectively calculated as 101.5% and 96.5%, the product was analyzed by XRD, this product was a single phase of the titanium metal, and oxygen and nitrogen contents of the product were analyzed, respectively 275 ppm and 165 ppm.

Embodiment 10

80.2 g of ilmenite ($TiO_2$ 49.0 wt %) and 20.0 g of petroleum coke (C content 89.0%) were weighed, uniformly mixed in a star type ball mill, and press-molded at a pressure of 30 MP; a block body was placed in a closed normal-pressure heating furnace, heated to 1200° C. under a $NH_3$ atmosphere and held for 240 min, wherein it was found that a reaction rate was 97.6% by calculating a weight loss rate, a structure and a composition of a product were analyzed by XRD, titanium dioxide and carbon were transformed into a titanium compound ($TiC_xO_yN_z$) phase, a conductivity of a press-molded block body was sharply reduced to 0.005 ohm·cm from an original 60-70 ohm·cm. A $CaF_2$—KF—NaF—$Na_2TiF_6$ salt was contained by using a titanium alloy crucible, wherein a mass percent concentration of Ti ions was 6%; an electrolysis experiment was conducted at 850° C. The prepared titanium compound ($TiC_xO_yN_z$) served as an anode, with an anode current density of 0.90 A/cm$^2$, a constant current electrolysis was conducted, and online monitoring was conducted on a gas composition at the anode by using an online high-sensitivity gas sampling system and a mass spectrometer to analyze that gases emitted from the anode are $N_2$, $CO_2$ and CO, a nickel metal was selected as a cathode, with a cathode current density of 0.90 A/cm$^2$, a space between the cathode and the anode was controlled to 20 cm, a constant current electrolysis was conducted, the anode and the cathode were taken out after 2 h and then an electrolyte on surfaces of the cathode and the anode was cleaned respectively by using 1 wt % diluted hydrochloric acid, then chloride ions were cleaned with deionized water, and then the cathode and the anode were dried. Current efficiencies of the anode and the cathode were respectively calculated as 94.5% and 93.7%, the product was analyzed by XRD, this product was a single phase of the titanium metal, and carbon, oxygen and nitrogen contents of the product were analyzed, respectively 83 ppm, 375 ppm and 265 ppm.

Embodiment 11

Titanium-iron concentrate ($TiO_2$ 69.0 wt %) and 20.0 g of graphite powder (C content 99.9%) were weighed, uniformly mixed in a star type ball mill, and press-molded at a pressure of 40 MP; a block body was placed in a closed normal-pressure heating furnace, heated to 1600° C. under a $N_2$ atmosphere and held for 360 min, wherein it was found that a reaction rate was 99.6% by calculating a weight loss rate, a structure and a composition of a product were analyzed by XRD, an original mixed phase of titanium dioxide and graphite powder was transformed into a single titanium compound ($TiO_xN_y$) phase, a conductivity of a press-molded block body was sharply reduced to 0.02 ohm·cm from an original 135-145 ohm·cm. A $CsCl_2$—LiCl—$TiCl_2$—$TiCl_3$ salt was contained by using a titanium alloy crucible, wherein a mass percent concentration of Ti ions was 1%; an electrolysis experiment was conducted at 750° C. The prepared titanium compound ($TiO_xN_y$) served as an anode, with an anode current density of 1.00 A/cm$^2$, a constant current electrolysis was conducted, a molybdenum metal was selected as a cathode, with a cathode current density of 1.00 A/cm$^2$, a space between the cathode and the anode was controlled to 6 cm, a constant current electrolysis was conducted, the anode and the cathode were taken out after 2 h and then an electrolyte on surfaces of the cathode and the anode was cleaned respectively by using 1 wt % diluted hydrochloric acid, then chloride ions were cleaned with deionized water, and then the cathode and the anode were dried. Current efficiencies of the anode and the cathode were respectively calculated as 94.5% and 93.7%, the product was analyzed by XRD, this product was a single phase of the titanium metal, and oxygen and nitrogen contents of the product were analyzed, respectively 475 ppm and 249 ppm.

Embodiment 12

Figure 7:
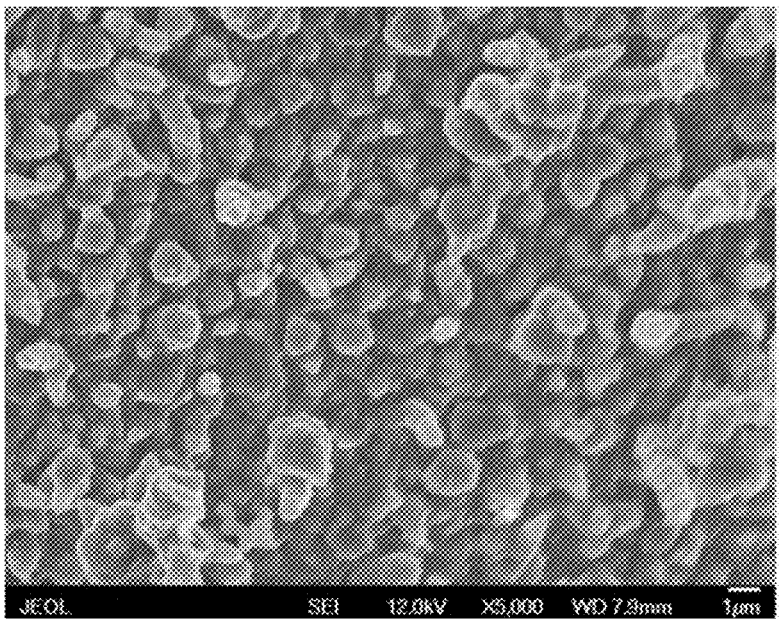
FIG. 7 is a SEM schematic view of a product at a cathode according to an embodiment 12 of the present invention.

The titanium compound ($TiC_xO_yN_z$) prepared in the embodiment 1 served as an anode, with an anode current density of 0.50 A/cm$^2$, a constant current electrolysis was conducted in a NaCl—KCl—$TiCl_2$ molten salt system at 700° C., wherein a mass percent concentration of Ti ions was 8%, stainless steel was selected as a cathode, with a cathode current density of 0.50 A/cm$^2$, a space between the cathode and the anode was controlled to 3 cm, the anode and the cathode were replaced every other 2 h to continuously electrolyze for 20 h. 20.8 g of titanium metal was electrolyzed in total, and there was 5 g of titanium ions in an electrolyte in total. There was no change in a concentration of the electrolyte after continuous long-term electrolysis, which indicated that 20.8 g of titanium metal obtained by electrolysis was obtained by electrolyzing a titanium compound ($TiC_xO_yN_z$). The electrolyte on surfaces of the cathode and the anode was cleaned by using 1 wt % diluted hydrochloric acid, chloride ions were cleaned with deionized water, and the cathode and the anode were dried. A product was analyzed by XRD, the product was a single phase of the titanium compound, it could be seen from FIG. 7 of the description that titanium metal particulates with a size of about 2 μm were obtained, the current efficiency of the cathode is calculated as 95.5%, and carbon, oxygen and nitrogen contents of the product were analyzed, respectively 55 ppm, 227 ppm and 125 ppm.

The invention claimed is:

1. A method for electrowinning titanium from a titanium soluble anode molten salt, comprising:

mixing a titanium-containing material and a carbon-containing reducing agent at a molar ratio of 5:1-1:20 to form a raw material;

press-molding the raw material;

heating the press-molded raw material at a temperature ranging from 1000° C. to 2000° C. in an ammonia-containing atmosphere for 30-600 min to obtain an anode material, wherein said titanium-containing material comprises one or more compound chosen from rutile type titanium white, anatase type titanium white, metatitanic acid, ilmenite, vanadium titano-magnetite, blast furnace type high-titanium slag, high-titanium slag, or low valence oxides of titanium, and said carbon-containing reducing agent comprises one or more compound chosen from carbon, activated carbon, graphite powder, charcoal, petroleum coke, asphalt, or coal coke particulate, and said anode material is $TiC_xO_yN_z$ or $TiO_xN_y$, wherein, in said $TiC_xO_yN_z$, $0<X\leq Y<1$, $0<Z<1$, and $X+Y+Z=1$; in said $TiO_xN_y$, $0<X\leq Y$ and $X+Y=1$;

preparing an anode electrode using said anode material; and electrowinning titanium in an electrolysis cell comprising the anode, a halide molten salt electrolyte comprising an alkali metal, an alkaline earth metal, or both, and a cathode, wherein titanium is obtained at the cathode.

2. The method according to claim 1, wherein the ammonia-containing atmosphere is ammonia or a mixture comprising ammonia and one compound chosen from nitrogen, argon, or hydrogen.

3. The method according to claim 2, wherein the ammonia-containing atmosphere is ammonia.

4. The method according to claim 1, wherein said low valence oxide of titanium is chosen from $Ti_2O_3$, $Ti_3O_5$, TiO, or $Ti_3O$.

5. The method according to claim 1, wherein the anode material is prepared under a positive pressure in the ammonia-containing atmosphere.

6. The method according to claim 1, wherein the anode material is prepared under a normal pressure or a negative pressure in the ammonia-containing atmosphere.

7. The method according to claim 1, wherein said halide molten salt electrolyte comprises one or more metal halides chosen from $CsCl_2$, $CaCl_2$, LiCl, NaCl, KCl, $MgCl_2$, $AlCl_3$, CaF, NaF, KF, or LiF; and one or more titanium-containing salt chosen from $TiCl_3$, $TiCl_2$, $K_2TiF_6$, or $Na_2TiF_6$, wherein a mass percent concentration of Ti ions in said molten salt electrolyte system is 1%-10%.

8. The method according to claim 1, wherein a molar ratio of said titanium-containing material to said carbon-containing reducing agent is 5:1-1:10.

9. The method according to claim 1, wherein an electrolysis temperature ranges from 400° C. to 900° C.

10. The method for according to claim 1, wherein a space between said cathode and said anode in the electrolysis cell is between 3 cm and 40 cm, and the electrolysis cell has a cell voltage ranging from 1.5 V to 6.0 V, an anode current density ranging from 0.05 A/cm$^2$ to 1.00 A/cm$^2$, and a cathode current density ranging from 0.05 N cm$^2$ to 1.00 A/cm$^2$.

11. The method according to claim 1, wherein said halide molten salt electrolyte is placed in a stainless steel crucible, a carbon steel crucible, a titanium crucible, a titanium alloy crucible, a graphite crucible, a molybdenum crucible, or a nickel crucible.

12. The method according to claim 1, wherein said cathode is made from titanium, stainless steel, carbon steel, molybdenum, or nickel.

13. The method according to claim 1, wherein a space between said cathode and said anode in the electrolysis cell is between 1 cm and 50 cm.

14. The method according to claim 1, wherein the electrolysis cell has a cell voltage of ranging from 0.5 V to 10.0 V, an anode current density ranging from 0.05 $A/cm^2$ to 1.50 $A/cm^2$, a cathode current density ranging from 0.05 N $cm^2$ to 1.50 $A/cm^2$, and an electrolysis temperature ranges from 300° C. to 1000° C.

* * * * *